US007240665B2

(12) United States Patent
Hoshino et al.

(10) Patent No.: US 7,240,665 B2
(45) Date of Patent: Jul. 10, 2007

(54) METHOD AND APPARATUS FOR CONTROLLING MOTOR-DRIVEN THROTTLE VALVE, AUTOMOBILE, METHOD OF MEASURING TEMPERATURE OF MOTOR FOR DRIVING AUTOMOTIVE THROTTLE VALVE, AND METHOD OF MEASURING MOTOR TEMPERATURE

(75) Inventors: Masatoshi Hoshino, Tsuchiura (JP); Katsuji Marumoto, Hitachi (JP); Minoru Oosuga, Hitachinaka (JP); Yasuhiro Kamimura, Hitachinaka (JP); Yasushi Sasaki, Urizura-machi (JP)

(73) Assignee: Hitachi, Ltd., Tokyo (JP)

( * ) Notice: Subject to any disclaimer, the term of this patent is extended or adjusted under 35 U.S.C. 154(b) by 18 days.

(21) Appl. No.: 11/304,789

(22) Filed: Dec. 16, 2005

(65) Prior Publication Data

US 2006/0090731 A1 May 4, 2006

Related U.S. Application Data

(60) Continuation of application No. 11/013,464, filed on Dec. 17, 2004, now abandoned, which is a division of application No. 10/048,067, filed as application No. PCT/JP99/04060 on Jul. 28, 1999, now Pat. No. 6,837,217.

(51) Int. Cl.
*F02D 41/26* (2006.01)

(52) U.S. Cl. ..... 123/399

(58) Field of Classification Search ..... 123/361, 123/399, 689

See application file for complete search history.

(56) References Cited

U.S. PATENT DOCUMENTS

| | | | | |
|---|---|---|---|---|
| 4,759,329 | A * | 7/1988 | Nobuo et al. | 123/399 |
| 5,115,396 | A * | 5/1992 | Keegan | 123/361 |
| 5,333,584 | A * | 8/1994 | Kamio et al. | 123/399 |
| 5,406,920 | A * | 4/1995 | Murata et al. | 123/399 |
| 6,098,594 | A * | 8/2000 | Kowatari et al. | 123/399 |
| 6,499,461 | B2 * | 12/2002 | Kubota et al. | 123/361 |
| 6,510,839 | B1 * | 1/2003 | Pursifull | 123/399 |
| 2003/0084873 | A1 * | 5/2003 | Ishida et al. | 123/399 |
| 2003/0136377 | A1 * | 7/2003 | Kowatari et al. | 123/399 |

FOREIGN PATENT DOCUMENTS

| | | |
|---|---|---|
| JP | 61-138852 | 6/1986 |
| JP | 2-256839 | 10/1990 |
| JP | 6-88543 | 3/1994 |
| JP | 8-303285 | 11/1996 |
| JP | 9-317538 | 12/1997 |

* cited by examiner

*Primary Examiner*—Erick Solis
(74) *Attorney, Agent, or Firm*—Crowell & Moring LLP

(57) ABSTRACT

A method is provided for easily avoiding undesirable effects on various physical values due to the change in temperature of a motor for driving a throttle valve without causing secondary problems. A technique is also provided for measuring the temperature of the motor electrically. The method uses a compensation device for correcting the power supply to the motor by detecting the impedance of the motor windings and/or the change in the motor temperature. The temperature of the motor is estimated from the current and voltage to the motor.

3 Claims, 11 Drawing Sheets

METHOD AND APPARATUS FOR CONTROLLING MOTOR-DRIVEN THROTTLE VALVE, AUTOMOBILE, METHOD OF MEASURING TEMPERATURE OF MOTOR FOR DRIVING AUTOMOTIVE THROTTLE VALVE, AND METHOD OF MEASURING MOTOR TEMPERATURE

CROSS REFERENCE TO RELATED APPLICATIONS

This application is a continuation of U.S. patent application Ser. No. 11/013,464, filed Dec. 17, 2004, now abandoned the entire disclosure of which is incorporated herein by reference, which is a divisional of U.S. patent application Ser. No. 10/048,067, filed Jan. 28, 2002, now U.S. Pat. No. 6,837,217, which is the U.S. national phase of PCT/JP99/04060, filed Jul. 28, 1999.

TECHNICAL FIELD

The present invention relates to a motor-driven throttle valve controller for an automobile in which the opening of the throttle valve is controlled by the motor and a control method thereof, and also relates to an automobile having the motor-driven throttle valve controller and a method of measuring the temperature of the motor used for such an automobile.

BACKGROUND ART

In the motor-driven throttle valve controller described in the Japanese Patent Application Laid-Open No. 9-317538, the overshoot and the delay of the attainment time to the target opening are improved by comparing the rate of change of the opening of the throttle valve with the standard rate of change, determining whether it is in the overshoot cause area or in the settling delay area, and correcting the control gain of each term (proportion term, integration term, and differentiation term) of PID in the control duty arithmetic expression for controlling the opening even if there is the change in the environmental temperature.

Further, in the Japanese Patent Application Laid-Open No. 8-303285, the feedback control is done to decrease the deviation between the electric currents by detecting the electric current which flows to the direct current motor for driving the throttle valve, and comparing the current value with the target current value of the motor. The overshoot and the delay of the attainment time to the target opening can be cancelled to some degree in such prior art. However, the standard rate of change to judge whether it is in the overshoot cause area or in the settling delay area is different according to an individual motor in the former case. Further, this is different according to the control characteristic of the throttle opening control.

Therefore, it is necessary to determine the standard rate of change peculiar to each product, and work is bad.

A concrete solution is not described though there is the description with the idea of the addition of the correction to the control of the DC motor according to the change in an environmental temperature by measuring the change in an environmental temperature by the temperature sensor.

Further, the mechanical response delay of the motor might cause the hunting of control system in the latter case.

DISCLOSURE OF INVENTION

An object of the present invention is to delete an undesirable influence on various physical values caused by the temperature change in a motor for driving a throttle valve without causing a secondary problem and by using an easy method. There is a throttle valve opening as one of the physical values.

Further, the engine speed and the intake air amount of the automobile are one in the physical value.

Further, the present invention provides the technology to measure electrically the temperature of the motor, too.

The compensator for compensating the supply capability to the motor by detecting the change in the temperature and the impedance of the winding of said motor is provided in the present invention from this respect.

Further, in the present invention, the throttle valve is fixed to the opening when control parameter for determining the supply capability to the motor is maintained to a constant value. The rate of change of the supply electric current and the applied voltage to the motor with respect to time when the accelerator pedal is stepped down under such a condition is different depending on the temperature of the motor.

Further, when a specific value is given as a throttle opening control instruction signal with feedback by the output of the throttle opening sensor invalidated, the specific value of the control instruction signal is different according to the temperature condition of the motor in the present invention.

Further, in the present invention, the compensator for compensating the supply capability to motor is provided so that the opening of the throttle valve should not change even if the temperature of the motor and/or the impedance of the winding of the motor change.

Further, the present invention provides the automobile in which the engine speed does not change even if the temperature of the motor and/or the impedance of the winding of the motor change.

Further, the present invention provides the automobile in which the measurement value of an air flow sensor of the engine does not change even if the temperature of the motor and/or the impedance of the winding of the motor change.

In the present invention, because the amount of supply capability to the motor is corrected by measuring the temperature of the motor, it is not required to perform special work to obtain the peculiar value of the reference value etc. even though the control which corresponds to an individual motor is possible.

In another invention, it is possible to measure the temperature of the motor without using the sensor.

Further, in a further invention, the engine speed of the automobile and the detection value of the intake air amount never become unstable by the change in the temperature of the throttle valve driving motor.

BEST MODE FOR CARRYING OUT THE INVENTION

Figure 1A:
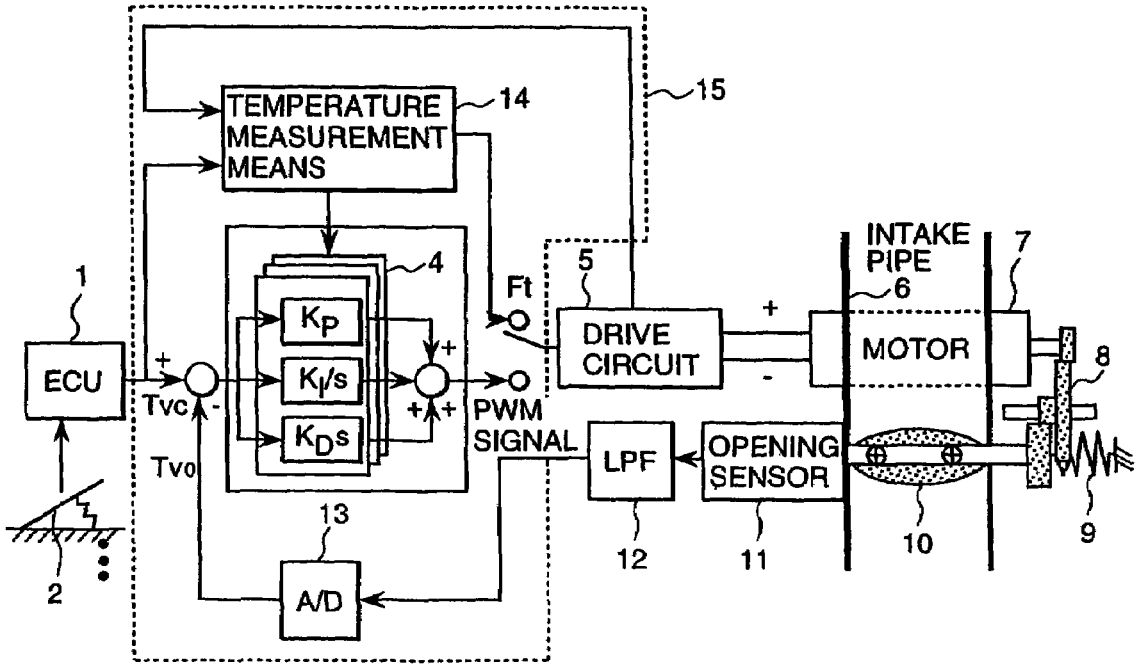
FIG. 1 is a block diagram showing the configuration of the present invention.

Control system by which the signal which drives the motor is calculated at a fixed cycle based on the opening of the throttle valve detected by the opening sensor and the given target value is necessary to control the opening of the throttle valve to the given value. A nonlinear PID control is widely used as an easy control system now. In the PID control, the deviation (difference between the opening and the target value), its integral values, and its differentiated value are obtained at a fixed timing with respect to the opening of the throttle valve detected by the opening sensor and the given target value. Further, each value is multiplied by a suitable constant (hereafter, it is referred as the PID gain), and the motor is driven by using the sum of the products.

However, because the dynamic characteristic of the throttle valve is nonlinear, the friction of the axis circumferences of the motor and the valve greatly influences when the valve is moved finely to control the engine speed at the idling constantly for instance. Therefore, the steady-state deviation remains and the response of the valve opening to the target value deteriorates. Then, the PID gain is dynamically switched in proportion to the magnitude of deviation in order to cope with the nonlinear of the electronically controlled throttle as the controlled system. The gain to be switched is stored in the memory area which is called a map beforehand, and the gain corresponding to the occasional deviation is retrieved from the map to use as the PID gain. The PID gain to be stored can be roughly calculated from the simulation and the specification such as motors and gears of the drive system of the valve. However, to meet the demand of the response for the target value, the PID gain is often fine adjusted based on the experiment.

The demand for the response to the target value of the throttle valve opening has the response time, the transition characteristic and the resolution. Response time should be assumed to be a value without the sense of incompatibility for driver's accelerator operation. Further, a lot of throttle valves are the butterfly valves. The position of full-open and full-close of the valve is determined by the deceleration gear's coming in contact with a stopper physical, or the throttle valve's coming in contact with the wall of the intake pipe, and thus the movable range of the valve is limited to about 90 degrees. At this time, an abnormal impact is applied to the valve and the gear and thus they will be in danger of damage when the target value of opening momentarily changes from the almost full-close into the full-open for instance, and the valve overshoots. It is necessary not to generate a transitional overshoot meeting the demand on the response time as the response of the throttle valve. Further, when the control of the engine speed at the idling is controlled not by the amount of the by-pass air flow which flows through the passage where the throttle valve is bypassed, but by the electronically controlled throttle, the resolution of the throttle valve opening of 0.1 degrees or less is needed for instance.

On the other hand, the temperature of the electronically controlled throttle set up in the engine room has the possibility to change from −40° C. to about 120° C. for instance according to the temperature of the ambient air and the operating state of the engine. Therefore, the above-mentioned demand of the response time, the transition characteristic and the resolution should be satisfied in this wide temperature range. In general, the resistance between terminals becomes large as the temperature of the winding of the motor goes up, and the torque constant becomes small. Further, the viscosity resistance becomes small with the temperature of the winding rises in the axis of rotation in which the lubricant is enclosed. The above-mentioned character reverses when the temperature falls. This friction cannot be disregarded in the control of an electronically controlled throttle though it is difficult to know a general temperature characteristic about static or dynamic friction which relates to the resolution when the throttle valve is controlled.

Thus, because the characteristic of drive system of the throttle valve changes depending on the temperature, it is essentially difficult in the conventional map method in which the PID gain is switched according to the deviation to meet the demand for the valve operation in wide temperature range. Further, when trying to meet the requirement specification by enlarging the magnitude of the map, and increasing the number of the PID gain to be switched, a large amount of ROM area is needed in control unit. Further, because the temperature with the largest influence cannot be considered, it is difficult to secure the control performance. The gain is fine adjusted in consideration of the response of the valve under the management of the temperature of the electronically controlled throttle by using the thermostatic oven to determine the map of the PID gain experimentally. In this method, the repetition of the gain adjustment and the temperature change is necessary, the time required to change the temperature is long, and a large man-hour will be required up to obtain the best PID.

The above-mentioned problem is solved by detecting the atmosphere temperature by which a big influence is applied on the response of the throttle valve by using an easy method, and switching the PID gain according to the detected temperature in this embodiment.

In this embodiment, the following technologies are proposed.

The temperature of the throttle and the motor is measured, and the signal for said throttle valve opening and shutting control is corrected by using the measured temperature in the electronically controlled throttle controller for driving the motor for the throttle valve opening and shutting control based on the opening instruction signal of the throttle valve and the output of the sensor for detecting the opening of the throttle valve.

Further, when a specific value is given as said instruction signal with the feedback by the output of the throttle opening sensor invalidated, said control signal is changed by the temperature condition of the motor.

Further, this embodiment comprises a means for measuring the electric current which flows to the motor. The atmosphere temperature of said motor is estimated based on the electric current by said measurement means and the voltage applied to the motor when the opening of the throttle valve within the fixed time range is in a fixed range.

Embodiments of the present invention will be explained more in detail with reference to the drawing.

Figure 1B:
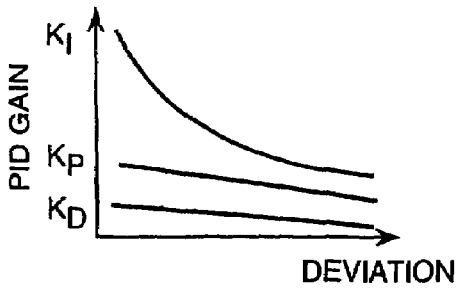
Figure 1C:
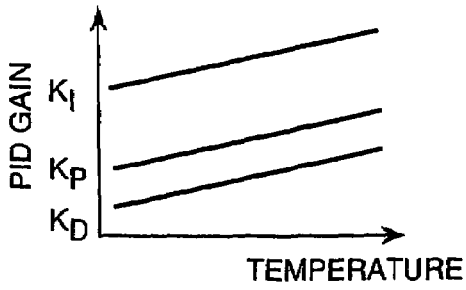
Figure 2:
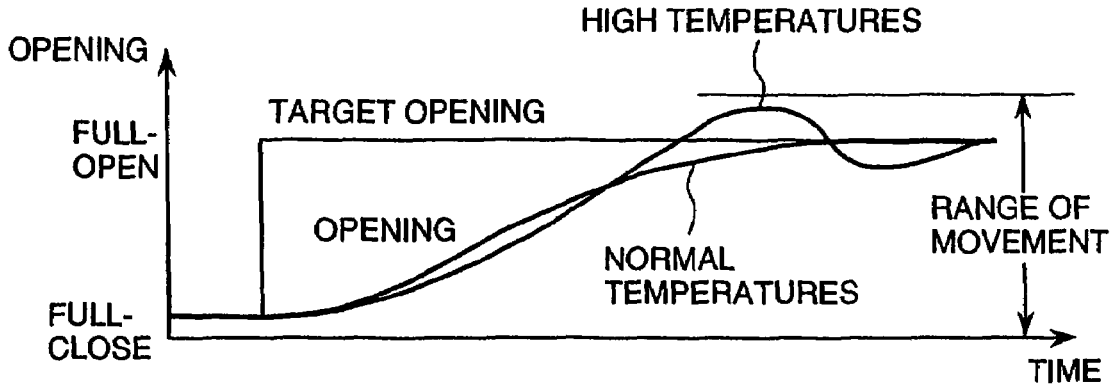
FIG. 2 is a graph showing schematically the response waveform to the target opening of the throttle valve.

FIG. 1 is a block diagram showing one example of the configuration in which the opening of the electronically controlled throttle valve is controlled according to the method of the present invention. An electronically controlled throttle is a device to drive throttle valve 10 comprised of a butterfly valve for adjusting the air flow rate which flows to intake pipe 6 by using DC motor 7 through deceleration gear 8. As a mechanical fail safe mechanism which prevents the reckless driving of the automobile, the valve is returned to the predetermined opening by return spring 9 mounted on the axis of rotation of the valve when motor 7 does not generate the torque, for example, at the discontinuation of the control of the throttle valve. The predetermined opening is set for the automobile to self-propell at a little higher engine speed than the idling. Drive circuit 5 of motor 7 comprises with an H bridge circuit which consists of four power IC. When the duty ratio is given, drive circuit 5 generates the corresponding PWM (pulse width modulator) power signal. The actual opening of throttle valve 10 is measured by opening sensor 11 (potentiometer) mounted on the axis. The noise of the output of opening sensor 11 is removed through low pass filter LPF 12, and then the output is taken into microcomputer 15 by AD converter 13. The target opening of throttle valve 10 is given by the signal from accelerator 2 taken into the engine control unit (ECU) 1 and the signal indicative of the various operating state of the engines. In PID control system achieved by using the software in microcomputer 15, the difference (deviation) between target opening Tvc and actual opening Tvo may decrease, that is, the duty ratio of the PWM signal is calculated so that both can be promptly matched. And, drive circuit 5 drives the motor according to the calculated duty ratio. Proportional gain KP, integration gain KI, and differentiation gain KD which are gains of the PID control system are recorded in map 4 as shown in FIG. 1(*b*), and these gains are changed depending on the magnitude of deviation. This is to cope with the nonlinear characteristic of physical value including the friction included in electronically controlled throttle. For instance, time until settling to the target opening increases because the speed of the valve slows and the influence of friction increases when the opening of the valve approaches the target value. The response time is set not to become long by enlarging KI which affects settling when the deviation is small. The map of the PID gains is made repeating the experiment by a real machine based on calculated value by the simulation. However, the change takes place in the viscosity of the grease of the bearing and the impedance of the winding of the motor when the atmosphere temperature rises, in case that the map is made by this method, and it is set so that the response of a preferable valve as shown in FIG. 2 can be obtained at normal temperature. Therefore, the transition characteristic of the PID gain provided at normal temperature might deteriorate. Then, the PID gain is changed by not only deviation but also the temperature as shown in FIG. 1(*c*) by providing thermometry control means 14. Thermometry control means 14 inputs signals from engine control unit 1 and drive circuit 5, and switches the PID gain by using the temperature of the motor obtained by the calculation based on FIG. 1(*c*). Further, thermometry control means 14 switches the signal input to drive circuit 5, and selects either of a feedback control signal (PWM signal) based on output Tvo of opening sensor 11 or an open loop control signal Ft generated in thermometry control means 14 itself.

Five methods of achieving the thermometry control means for measuring the atmosphere temperature of the electronically controlled throttle will be concretely described as follows. Two methods, a method of estimating the temperature by obtaining the value of wire-wound resistor of the motor from the voltage and the electric current applied to the motor, and a method of measuring the temperature directly by a brief temperature sensor will be explained. Further, two methods of obtaining the temperature based on the signal from the engine control unit will be described.

Figure 3:
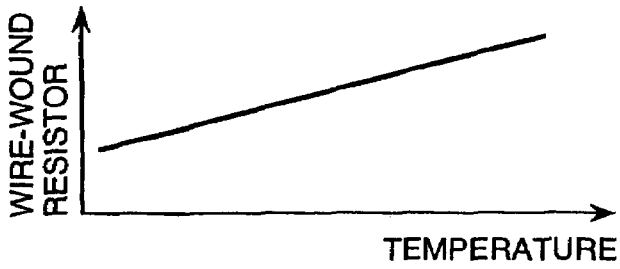
FIG. 3 is a view showing the relationship between the temperature and the wire-wound resistor of the motor.

The method of measuring (estimating) the temperature from wire-wound resistor of motor 7 will be explained hereinafter. It is necessary to obtain the value of resistance with the fixed accuracy in order to obtain the resistance from the ratio of the voltage and the electric current, and to obtain the temperature from the value of this resistance. Therefore, when the motor is stopped, it is necessary to provide a fairly big electric current stabilizing. When the motor is rotating, accurate electric resistance cannot be obtained according to the ratio of the voltage and the electric current because counter-electromotive force is generated. Further, it is difficult to measure contact resistance accurately though the resistance of the motor is the sum of the contact resistance the brush and the wirewound resistor, etc. Especially, when the motor is rotating or the applied voltage is small, the measurement error increases. It is preferable to apply a big voltage to reduce these influences when the motor is stopped and to obtain the resistance at that time. However, such a condition does not satisfied when the feedback control is done detecting the actual opening of the throttle valve as shown in FIG. 1. Then, when the temperature is obtained, the feedback control is stopped, and throttle valve 10 is fixed to full-close position by providing PWM signal Ft of a constant duty ratio from thermometry means 14 directly to drive circuit 5 in the open loop based on the signal from engine control unit 1 and the signal from drive circuit 5. Thermometry means 14 obtains the temperature of the motor 7 for driving the throttle valve as wire-wound resistor (impedance) of motor 7 by using the relationship between the resistance of the average applied voltage and the electric current at this time, and the relationship between the resistance and the temperatures shown in FIG. 3.

Figure 4:
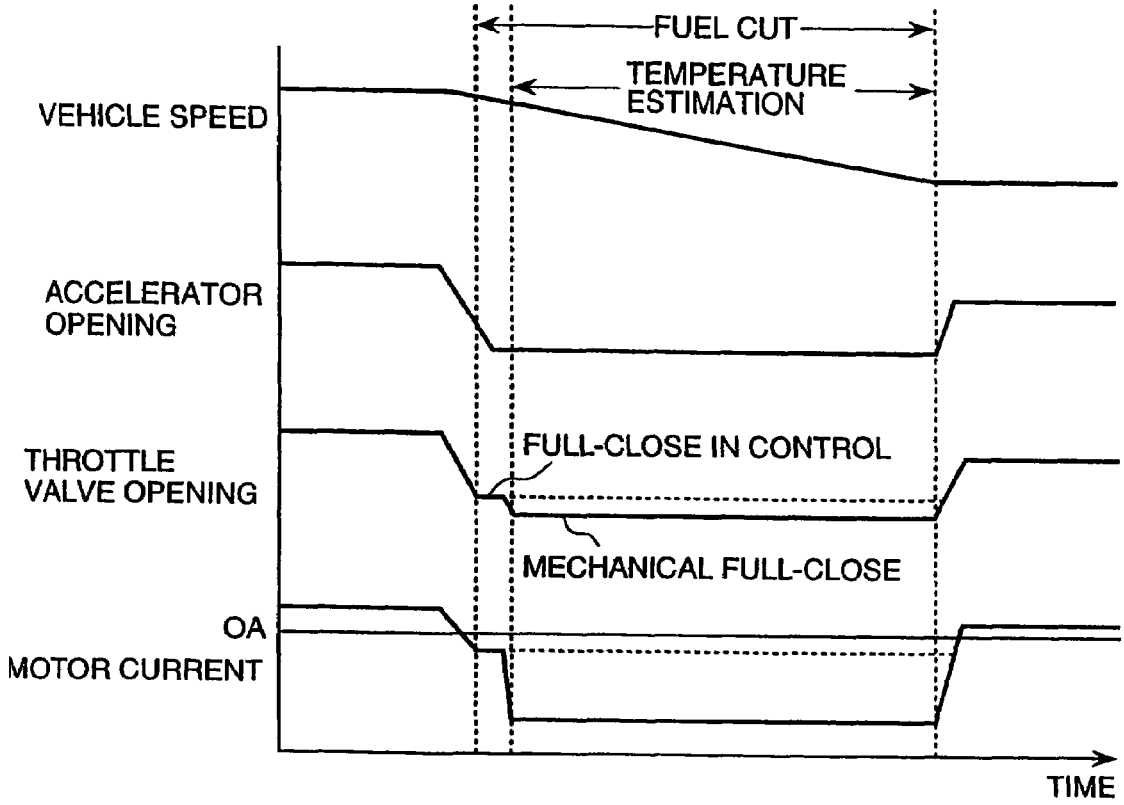
FIG. 4 is a graph showing the throttle valve and the motor electric current at the time the fuel is cut during deceleration.

When the driver completely closes the accelerator to improve fuel cost in a recent automobile and decelerates, the deceleration fuel cut mode in which the fuel is not injected is generally adopted. At this time, it is not necessary to perform especially the feedback control because throttle valve 10 is also fully closed as shown in FIG. 4. When the feedback control is done to prevent the collision to the intake pipe wall, etc. by the overshoot in the motor-driven throttle valve controller, the full-close position to be controlled in the target opening instruction is set at the position which opened more slightly than the mechanical full-close position (the position which comes in contact with the intake pipe wall and stopper). Anyway, the feedback control of FIG. 1 is stopped at the fuel cut when decelerating, and PWM signal Ft of a constant duty ratio is applied from thermometry means 14 to drive circuit 5 in this embodiment. The magnitude of the duty ratio is assumed 50% for instance, which resists the torque of the return spring by the feedback control, and which control the opening in the mechanical full-close position exceeding full-close position in the control. As a result, throttle valve 10 is pressed to the mechanical full-close position, and the current larger than one at the feedback control comes to flow into motor 7. As for the processing for this temperature estimation, time when the fuel is cut when decelerating is preferable. The driving characteristic is not negatively affected because at that time, throttle valve 7 is originally in the fully closed state. Further, the control to the above-mentioned full-close position does not exert the influence on the durability of the throttle valve controller because the full-close learning is carried out, that is, throttle valve 7 is pressed against the full-close position by adding a constant duty ratio immediately before the engine is started and the engine are stopped, in order to confirm the physical full-close position in a lot of motor-driven throttle controllers. Further, it is also possible to measure the temperature pressing the throttle valve against the full-close position within the range where there is no influence in the driving characteristic by a similar method when the throttle valve is open greatly and frequently like the engine of cylinder injection of fuel.

Figure 5:
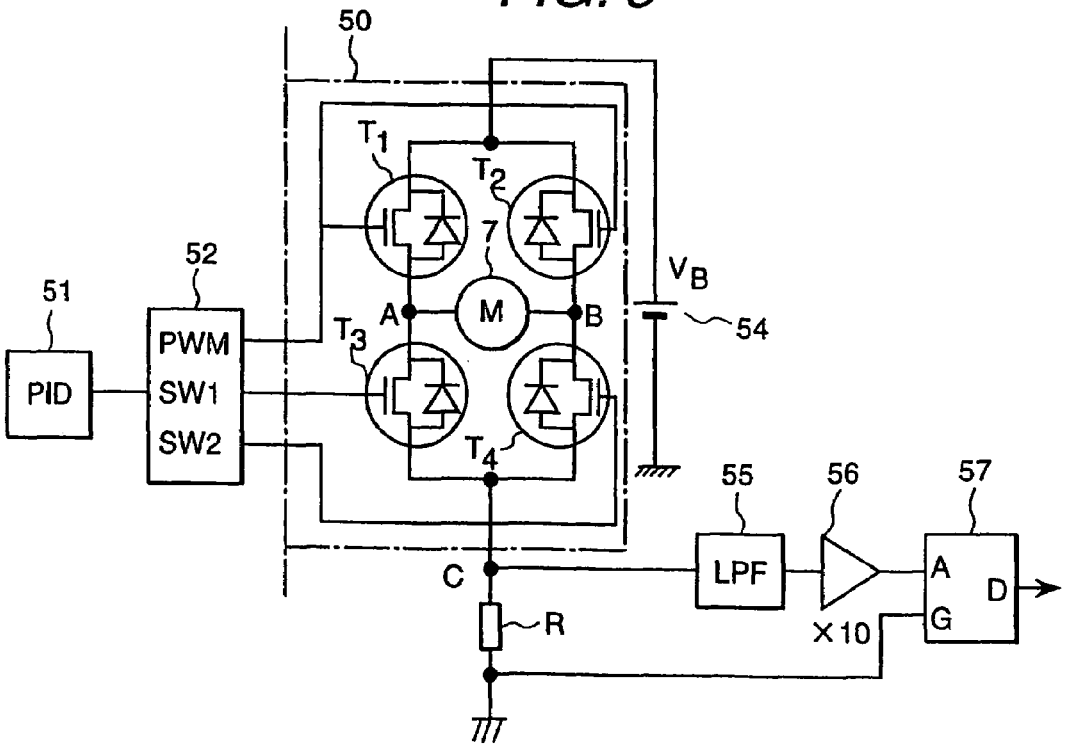
FIG. 5 is a view showing a detector applied to the drive circuit to measure the motor electric current easily.

One example of the circuit for measuring the electric current which flows to the motor is shown in FIG. 5. FIG. 5 shows the configuration in which detection resistance R is applied to drive circuit 50 which uses the H bridge which consists of power transistor T1, T2, T3, and T4, and resistance with few changes in resistance according to the temperature is chosen as the detection resistance R. The voltage to be applied to motor 7 obtained by PID control system 51 is converted into the PWM signal and the rotation direction signals (SW1, SW2) by PWM generation circuit 52. The PWM signal is input to power transistor T1 and T2, and rotation direction signal SW1 and SW2 are applied to power transistor T3 and T4.

If this circuit is used, the motor can be controlled in PWM by battery 54 including the rotation direction. Because the noise by the switching of power transistor is superimposed to the voltage at both ends of the detection resistance, A/D conversion of this voltage is performed after passing low-pass filter 55. Further, the both ends voltage is input to AD converter 57 through amplifier 56 because it is smaller than voltage average (TTL) of the AD converter built into a general microcomputer. The electric current which flows to the motor can be obtained from the resistance of detection resistance R and the voltage in C point of FIG. 5 measured here. There is the one to use the circuit like FIG. 5 to use for the self-diagnosis and the control in the electronically controlled throttle originally. The circuit can be used in common in that case, and it is unnecessary to change the hardware. Even when detection element is newly applied, the change of the circuit and the increase of the cost are little.

Figure 6:
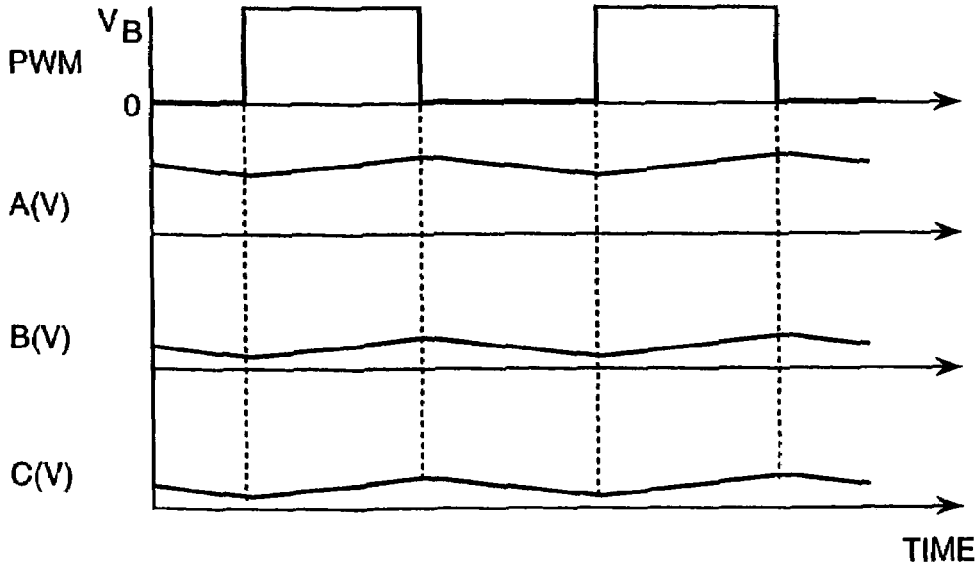
FIG. 6 is a graph showing schematically the relationship between the electric potential in each point of the drive circuit and the PWM signal.

In the drive circuit of FIG. 5, the relationship of the voltage at each point of A, B and C and the PWM signal becomes like FIG. 6. However, power transistor T3 must be turned off, T4 on, and the electric current must flow in order of A, B, and C. Further, an ideal case is shown in FIG. 6 though the switching of power transistor actually influences. The voltage at A point rises most due to the resistor of the winding of the motor, the "on" resistance of power transistor T4 and the detection resistance. It is the best to measure the voltage between terminals of detection resistance R in which the resistance is almost not changed due to the temperature at C point because the resistance of the winding of the motor and the power transistor change in their magnitude depending on the temperature.

Figure 7:
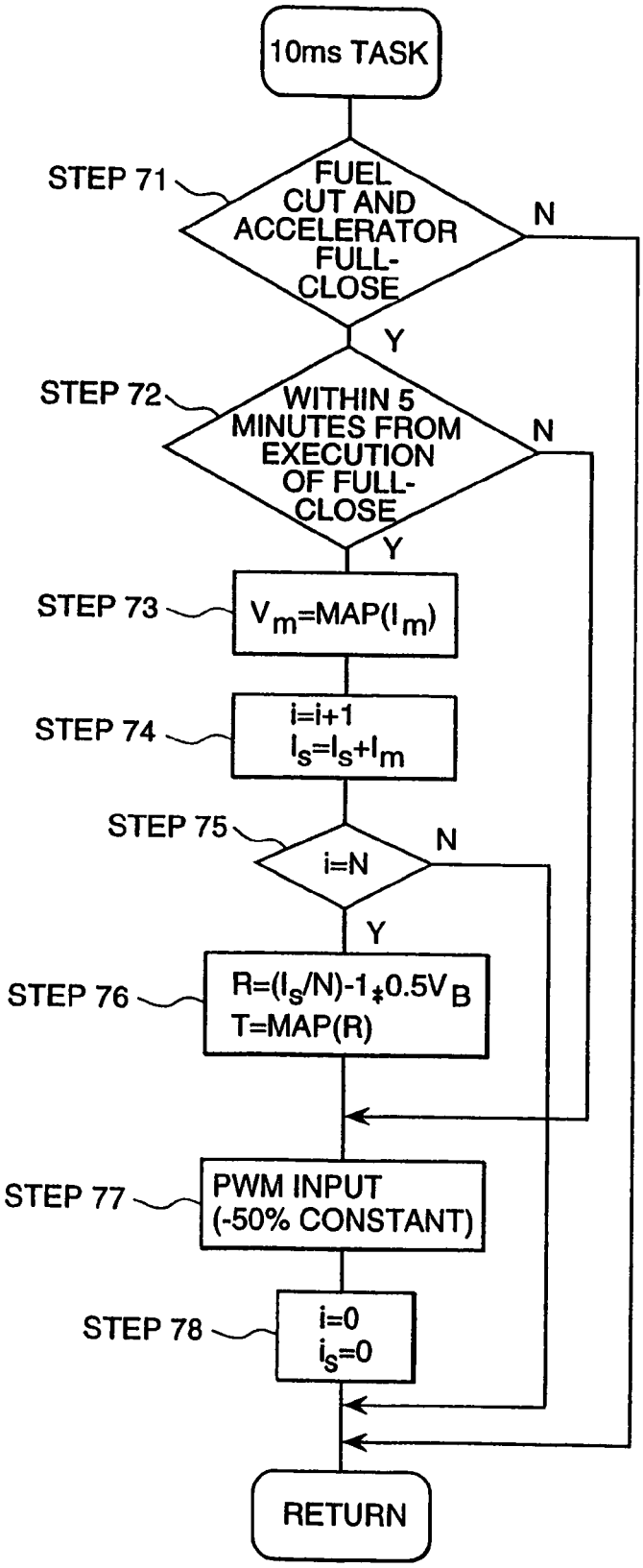
FIG. 7 is a flow chart where the processing to obtain the temperature at the time the fuel is cut during deceleration.

When the above-mentioned hardware is prepared, the flow chart of the processing of the software of the temperature detection is shown in FIG. 7. Because this processing estimates the temperature at the fuel cut, the cycle of processing is enough at the cycle when it is judged whether the engine control unit electronic control unit does the fuel cut. For instance, the undermentioned processing is repeated every 10 ms in this case. In step 71, communication with the engine control unit ECU is established, and whether the fuel cut when decelerating is done and whether the opening of the accelerator pedal is fully closed are confirmed. If either one is "NO", then this processing is ended. At this time, in the open loop control in which the feedback control has not already been done, the opening of the throttle valve is controlled to match to the target opening instruction value after returning to the usual feedback control. Whether it is within five minutes from the last thermometry processing is checked in step 72 after it is confirmed that the fuel is cut and the accelerator pedal are fully closed in the above-mentioned step 71. Accuracy is not improved even if the data taken after a lapse of five minutes or more is averaged because the current value measured by detection resistance R added to drive circuit 50 in this processing should be averaged. When it is away by five minutes or more from execution time of last time or does thermometry for the first time, the feedback control is stopped and a rotation direction signal and constant PWM control signal Ft are input to drive circuit 53 to press throttle valve 10 against full-close position in step 77. Step 78 is the initialization of the averaging processing. In step 73, the electric current which flows to the winding of motor 7 is obtained based on the map indicative of the correction of a nonlinear characteristic of the detector by using the both ends voltage of detection resistance R converted from analog to digital. In step 74 and 75, the electric current which flows to motor 7 is integrated till it reaches constant N. The winding resistance of the motor is obtained from the duty ratio of the applied PWM control signal Ft by averaging the current value in step 74 after the data of N piece is integrated. Further, the temperature is obtained from the map etc. in which the relationship between the resistance of the winding including copper as the major component and the temperature is described.

Next, two methods of composing the circuit for detecting the temperature will be described. One is a method in which the diode is used, and the other is a method with thermistor. It is possible to measure the temperature regardless of the operating state of the engine though the hardware for the temperature detection is added in these methods. Therefore, the software for the temperature detection becomes brief compared with the method using the above-mentioned fuel cut. The temperature is obtained at a suitable cycle in consideration of the heat mass of the throttle, and the PID gain is corrected based on the temperature. Concretely, the map where the gain is described for instance is switched.

Figure 8A:
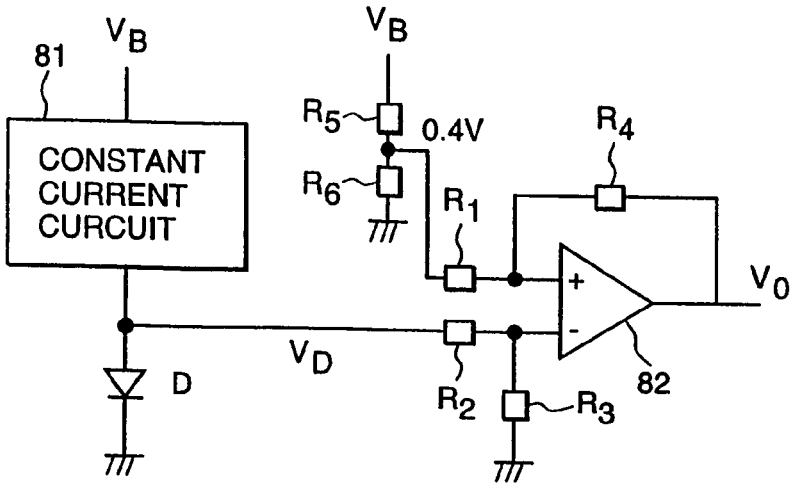
FIG. 8 is a view showing an electric current detector using the diode and its characteristic.
Figure 8B:
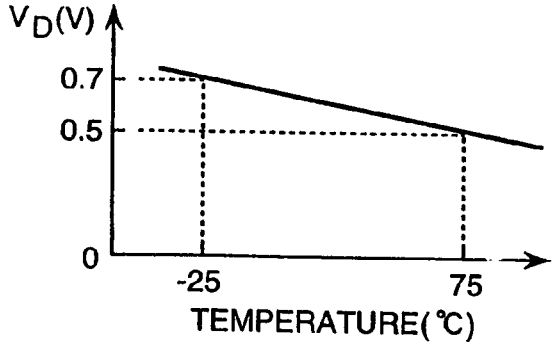
Figure 8C:
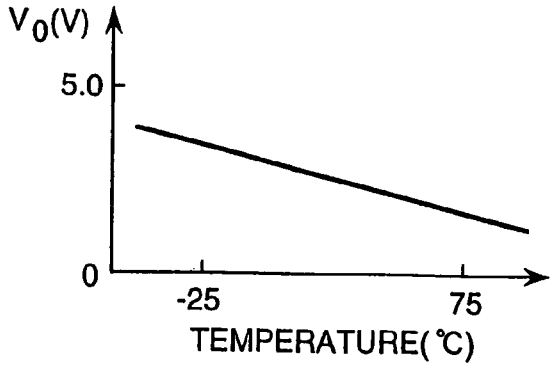

The configuration of the temperature detector which uses the resistance of the forward direction of the diode is shown in FIG. 8(*a*). A constant electric current is thrown from the battery into diode D by using constant-current circuit 81. If the electric current is constantly controlled, voltage VD applied to diode D has the characteristic like FIG. 8(*b*), for instance, for the temperature, although voltage VD applied to diode D is different according to the electric current. Because dynamic range for the AD converter built in microcomputer is narrow yet, the accuracy cannot be secured. Then, the amplifier which uses analog amplifier 82 is composed, and the characteristic of the voltage VD applied to the diode is converted into that of voltage V0 suitable for the A/D conversion shown in FIG. 8(*c*). The temperature can be obtained by converting from analog to digital and processing using FIG. 8(*b*).

Figure 9A:
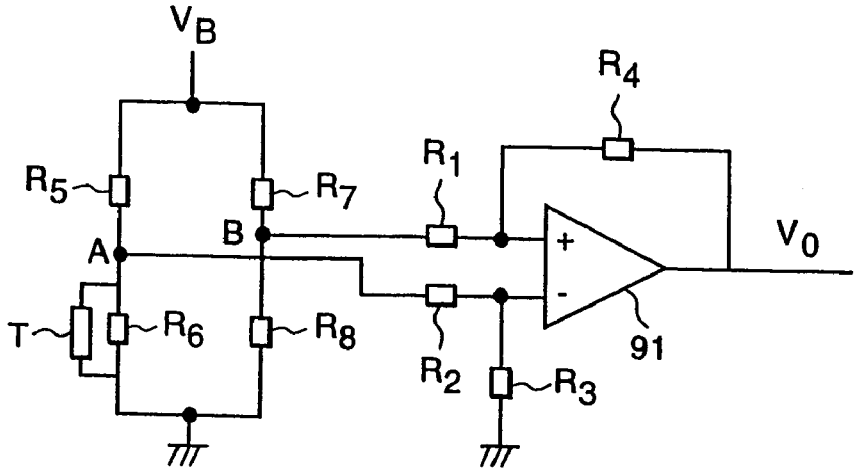
FIG. 9 is a view showing an electric current detector using the thermistor and its characteristic.
Figure 9B:
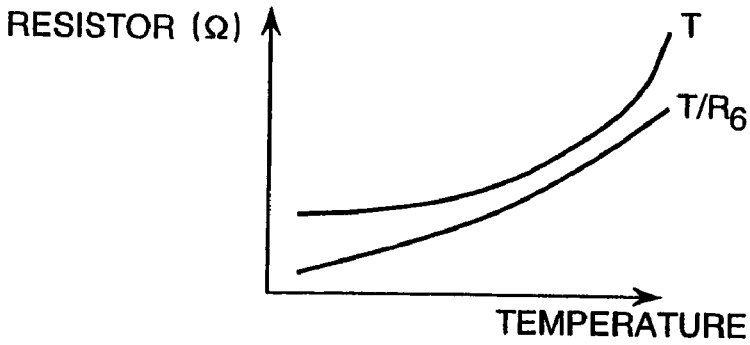
Figure 9C:
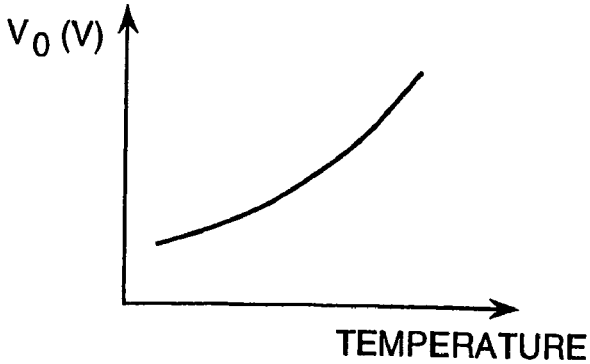

FIG. 9(*a*) shows the temperature detector which uses thermistor T. Because the temperature characteristic the resistance of thermistor T has a strong nonlinear as shown in FIG. 9(*b*), normal resistance R6 is connected in parallel. The change in potential is small in the range of the temperature change occurred in the motor-driven throttle valve controller as well as the temperature detection which uses the above-mentioned diode, although the potential of A and B of bridge circuit (R5–R8) changes in proportion to the temperature. Then, the amplifier is made with analog amplifier 91, and output voltage V0 is converted in A/D. Because the relationship of output voltage V0 of the analog amplifier and the temperature is like FIG. 9(*c*), the temperature is obtained from this characteristic.

Figure 10:
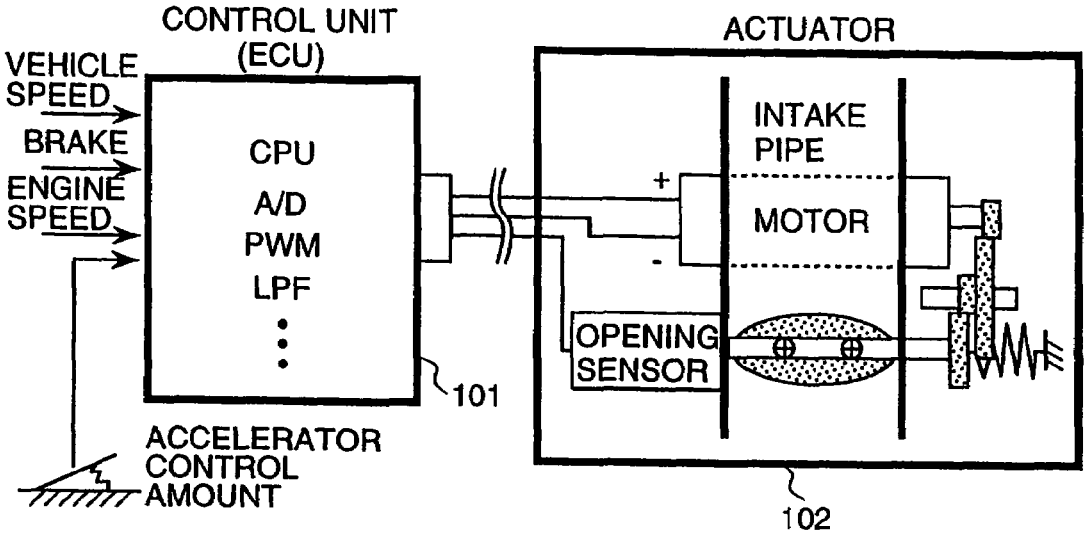
FIG. 10 is a view showing the configuration of the throttle actuator and control unit of the separate type.
Figure 11:
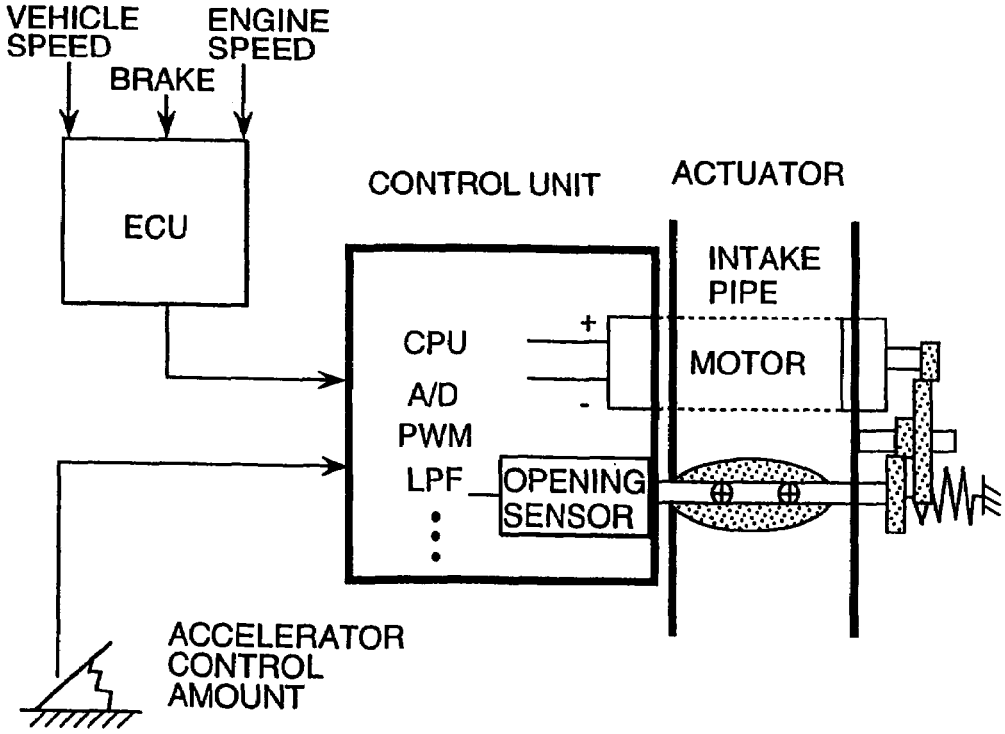
FIG. 11 is a view showing the configuration of the throttle actuator and control unit of the integrated type.
Figure 12:
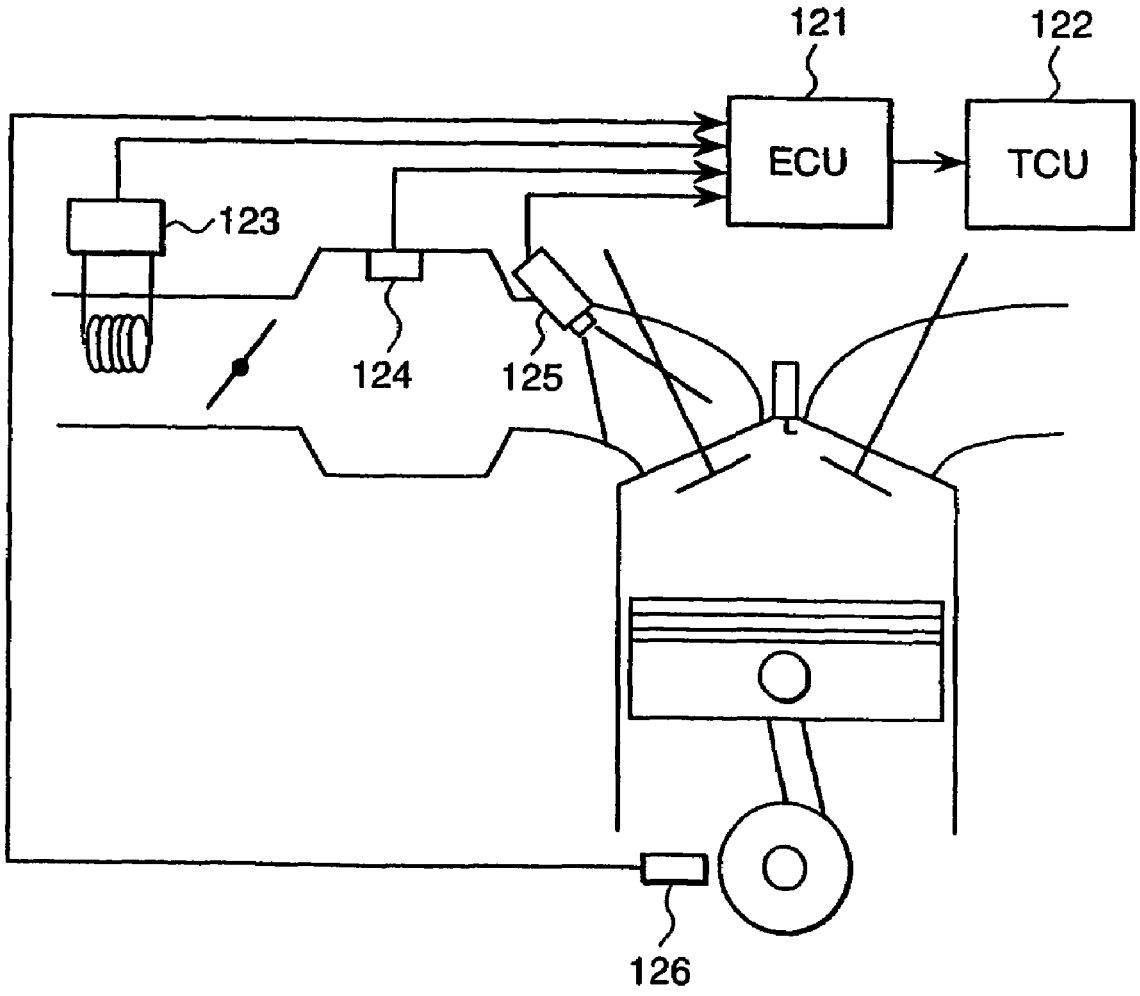
FIG. 12 is a block diagram of the method of estimating the temperature based on the signal from the engine control unit.

Although the motor-driven throttle valve controller comprises the control unit and the actuator which consists of the motor and the gear, the separate type in which both is separated like FIG. 10 and the integrated type like FIG. 11 etc. are thought. In the separate type configuration, control unit 101 is often put in the car interior. Therefore, the difference in temperature between control unit 101 and actuator 102 which is put in the engine room becomes large. Accordingly, it is preferable to use the method utilizing that the throttle valve becomes full-close at the fuel cut when decelerating in the separate type. The diode and the thermistor are provided to the actuator (housing of the motor or the throttle) in case of the use of the temperature detector. On the other hand, because of both the actuator and control unit in the engine room in the configuration of the integrated type shown in FIG. 11, the temperature of them becomes almost the same. Therefore, it is possible to mount the temperature detector on the substrate of control unit even when it is used. Naturally, the method of synchronizing with the fuel cut when decelerating without changing the circuit for the integrated type is also possible. In this case, it is suitable to receive the signal of the deceleration and the fuel cut from the electronic control unit according to the communication.

It is also possible to obtain the atmosphere temperature of the throttle approximately by using the signal in engine control unit 121. The temperature of the intake air can be calculated based on the state equation of the gas by passing the information on the intake air amount and the intake pipe pressure from the engine control unit to throttle control unit 122, in the engine in which intake air amount sensor 123 and pressure sensor 124 are installed in the intake pipe to control the engine. Of course, it is also possible to provide the temperature sensor which measures the temperature of the intake air directly. Anyway, the atmosphere temperature of the throttle can be obtained in the approximate value by making a suitable correction by using the map etc. though the temperature of the intake air is often lower than that of the motor of an electronically controlled throttle. Further, because the temperature of cooling water is measured by the temperature sensor in most engines for automobiles, the method of substituting the temperature of the motor at the water temperature is devised. In this case, accuracy improves if a suitable correction is made because the temperature of water is usually lower. Because the calorie generated by the engine and the air temperature remarkably influences on the atmosphere temperature of the motor-driven throttle valve controller, the amount of the fuel injected from injector 125 and the engine speed detected by rotation sensor 126 is used as a correction method. It is judged that the calorie generated by the engine is large when the engine speed and the amount of the fuel are large during the constant period. The temperatures of the intake air and cooling water are corrected to higher temperatures, and it is used as the temperature of the motor for driving the throttle valve. This relationship is settled experimentally and used in the map at the software implementation and used. For the control of the PID gain, The temperature compensation can be made without the problem on practical use even if the number of sheets of the map is a little when composing to select which map to be used, based on the temperature put together to three maps with the detected temperature range of the motor shown in FIG. 1, for instance, from −40° to 10°, 110° or less, from 10° to 80° and 80° or more.

According to the above-mentioned embodiment, the response of the throttle valve hardly changes even if there is a temperature change by the operating state of the engine because the gain of PID control system is corrected by measuring the atmosphere temperature which remarkably influences on the response of the throttle valve in the motor-driven throttle valve controller. Further, in the prior art, the gain has been switched according to the difference between the target opening and the actual opening. However, it is possible to reduce the map in which the gain is recorded can be reduced because the gain is controlled according to the temperature which influences directly. Further, it is possible to shorten the making time of the map which has required a large man-hour.

Figure 13:
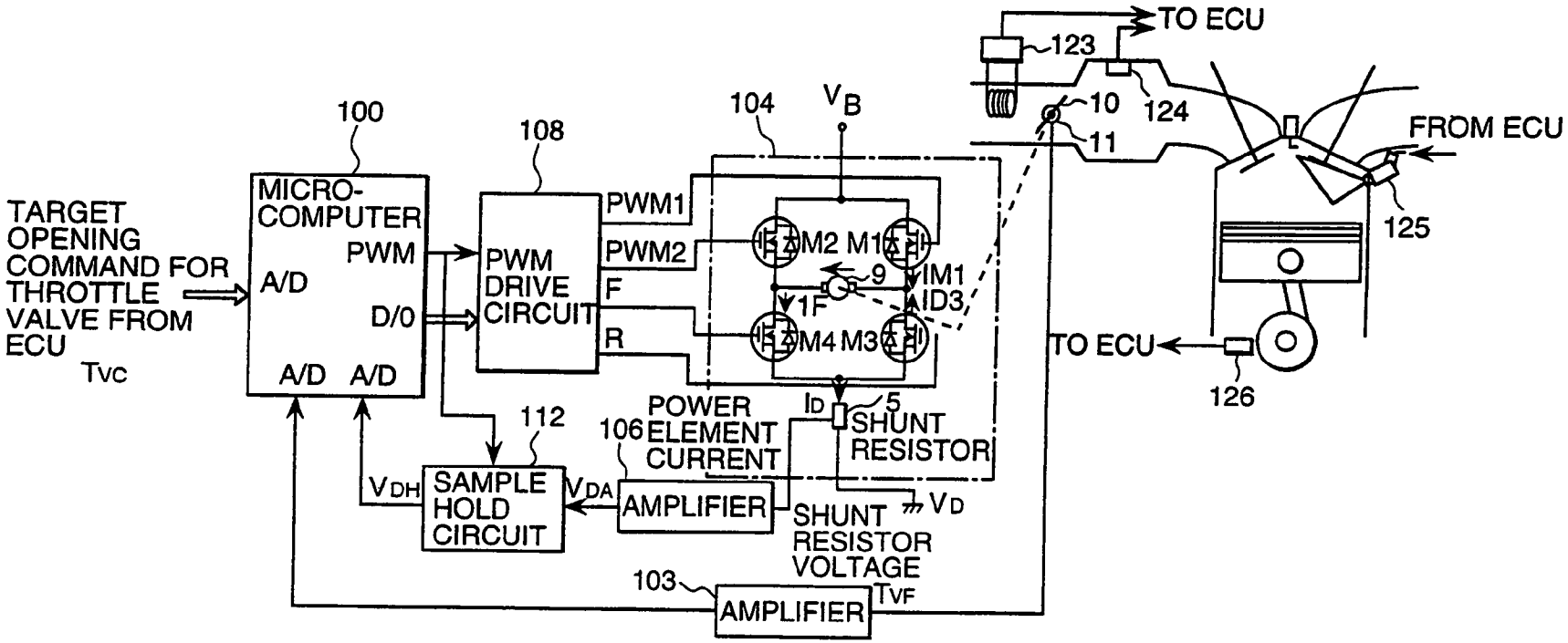
FIG. 13 is a concrete circuit diagram of another embodiment of the present invention.

FIG. 13 is a block diagram of the control system of the electronic throttle controller according to one embodiment of the present invention.

Target opening signal Tvc of the throttle valve which instructs the target opening of the throttle valve is input to an A/D input terminal of microcomputer 1, and converted into the digital signal by the A/D converter installed in microcomputer 1.

Target opening signal TVC of the throttle valve is an analog signal to which the control amount of the accelerator pedal detected by the accelerator pedal sensor.

Of course, it is possible to obtain target opening signal Tvc of the throttle valve as a digital signal by retrieving the analog signal indicative of the control amount of the accelerator pedal detected by the accelerator pedal sensor to the microcomputer of the engine control unit ECU, and retrieving by the map or carrying out the operation which includes other various physical values (the engine speed, the intake air amount, the vehicle speed, and the voltage of the battery, the magnitude and the presence or absence of the electric load such as air conditioners and lamps, etc.) in the microcomputer of the engine control unit ECU. It is unnecessary to carry out the A/D conversion in microcomputer 1.

The data signal indicative of the duty ratio like Tb/Ta, for example, can be given as a digital signal of target opening signal Tvc of the throttle valve, assuming that the cycle of PWM signal is Ta and the length of "ON" pulse is Tb.

The opening of throttle valve 10 installed in throttle body 2 rotatably is detected by potentiometer 11 united with the axis of throttle valve 10. The opening of throttle valve 10 detected by potentiometer 11 are amplified by amplifier 3 as actual opening signal $T_{VF}$ of the throttle valve, input to the A/D input of microcomputer 1, and converted to a digital signal by the A/D converter built in microcomputer 1.

Microcomputer 1 outputs control signal PWM and D/O to PWM drive circuit 8 based on input target opening signal $T_{VC}$ of the throttle valve and actual opening signal $T_{VF}$ of the throttle valve.

Control signal PWM is a pulse signal. The cycle of the pulse is constant, and the duty ratio of the pulse is changeable.

The duty ratio of the pulse is calculated in microcomputer 1 so that it may increase as the difference between target opening signal Tvc of the throttle valve and the actual opening signal $T_{VF}$ of the throttle valve.

Control signal D/O is a control signal of two bits indicative of four states of the rotation direction of motor 9, "Normal rotation", "Reversal" and "Stop" of motor 9, and "braking".

PWM drive circuit 8 outputs control signal PWM as control signal PWM1 and outputs control signal F indicative of the direction of the normal rotation at "Normal rotation" according to "Normal rotation" or "Reversal" indicative of the rotation direction of motor 9 among input control signal PWM and D/O. Control signal F is a signal which always turns on at the normal rotation.

Further, control signal PWM is output as control signal PWM2 at "Reversal", and control signal R indicative of the direction of the reversal is output. Control signal R is a signal which turns on when reversing.

H bridge type chopper 4 to which the control signal is supplied from PWM drive circuit 8 comprises of power MOSFETs M1, M2 for the PWM control, and power MOSFET M3, M4 for the rotation direction switch of the direct current motor.

Therefore, control signal PWM 1 and control signal F are output when control signal PWM is in a ON state and at the normal rotation, and power MOSFET M1 and power MOSFET M4 of H bridge type chopper main circuit 4. Power-supply voltage VB from battery B is applied to motor 9 via power MOSFET M1, thereby motor electric current IF flows. Further, the current IF returns to battery B through power MOSFET M4 and shunt resistance 5.

Although power MOSFET M1 is turned off when control signal PWM1 is turned off, power MOSFET M4 is still in an ON state because control signal F of the normal rotation is outputting. Therefore, motor electric current IF flows from power MOSFET M4 via a reverse-diode of power MOSFET M3, and flywheel current ID3 flows. Accordingly, motor electric current IF becomes electric current IM1 which flows in power MOSFET M1 when control signal PWM1 is in the ON state, and it becomes flywheel electric current ID3 which flows in MOSFET M3, the power when control signal PWM1 is in OFF state.

Further, control signal PWM2 and control signal R are output when control signal PWM is turned on and at the reverse rotation, and power MOSFET M2 and power MOSFET M3 of H bridge type chopper main circuit 4 are turned on.

Power-supply voltage VB from battery B is applied to motor 9 via power MOSFET M2, and motor electric current IF flows. Further, it returns to battery B through power MOSFET M3 and shunt resistance 5. Power MOSFET M2 is turned off when control signal PWM2 is turned off, and the motor electric current IF flows from power MOSFET M3 via a reverse-diode of power MOSFET M4. As a result, the flywheel electric current flows.

Thus, motor electric current IF flows to motor 9 in a direction opposite to that of normal rotation, and motor 9 can be reversed.

Motor 9 is a DC motor, but it is possible to use a stepping motor. Motor 9 is connected to throttle valve 10 through the deceleration gear, and throttle valve 10 is opened by the normal rotation of motor 9 and it is closed by the reverse rotation of motor 9. That is, the opening of throttle valve 10 can be controlled.

Power device electric current ID which flows in shunt resistance 5 will described later in detail with reference to FIG. 15.

This power device electric current ID is detected as shunt resistance voltage drop VD at both ends of shunt resistance 5, and is amplified by amplifier 6.

Because a part of shunt resistance 5 is at potential of the earth, and shunt resistance 5 is used for the electric current detection, which resistance is small.

Therefore, shunt resistance voltage VD is low compared with the drive voltage of amplifier 6, for instance, 5 V, and not an electric current detector of an expensive insulation type, but a usual amplifier can be used.

Output voltage VDA of this amplifier 6 is held in sample-hold circuit 12 working in synchronization with control signal PWM output from microcomputer 1. Output voltage VDH of sample-hold circuit 12 is input to the A/D input terminal of microcomputer 1, and converted into the digital signal by the AD converter built in microcomputer 1.

Power device electric current ID detected thus is compared with the control signal of the motor current obtained from the difference between target opening signal TVC of throttle valve and actual opening signal TVF of throttle valve, and feedback control of the motor current is performed by correcting the duty ratio of control signal PWM so that power device electric current ID can match the control signal of the motor electric current.

The throttle opening can fundamentally be controlled only by the feedback control based on the difference between actual opening signal TVF of the throttle valve and its target opening signal TVC.

However, the electric current which flows in motor 9 will actually change because the impedance of motor 9 changes even if other control parameters (the engine speed, the vehicle speed, the voltage of battery B, and the magnitude and the presence or absence of electric load, etc.) are constant, and control signal PWM output from microcomputer 1 is constant when the outside air temperature, the temperature of the motor and the winding temperature of the motor change.

Namely, the electric current which flows to the motor decreases when the outside air temperature, the temperature of the motor and the winding temperature of the motor rise.

The outside air temperature, the temperature of the motor, the winding temperature of the motor, the impedance of the motor (Obtained by calculation from the detected value of power device electric current I and the applied voltage), the temperature of the engine cooling water for cooling the motor, etc. are detected for the change in the motor electric current more than the target opening instruction from the ECU (engine control unit) The throttle opening can be controlled with a high degree of accuracy by increasing control signal PWM output by microcomputer 1 so that the decrease of the motor electric current may be compensated when the electric current which flows in the motor decreases, and thus increasing the motor electric current.

Figure 14:
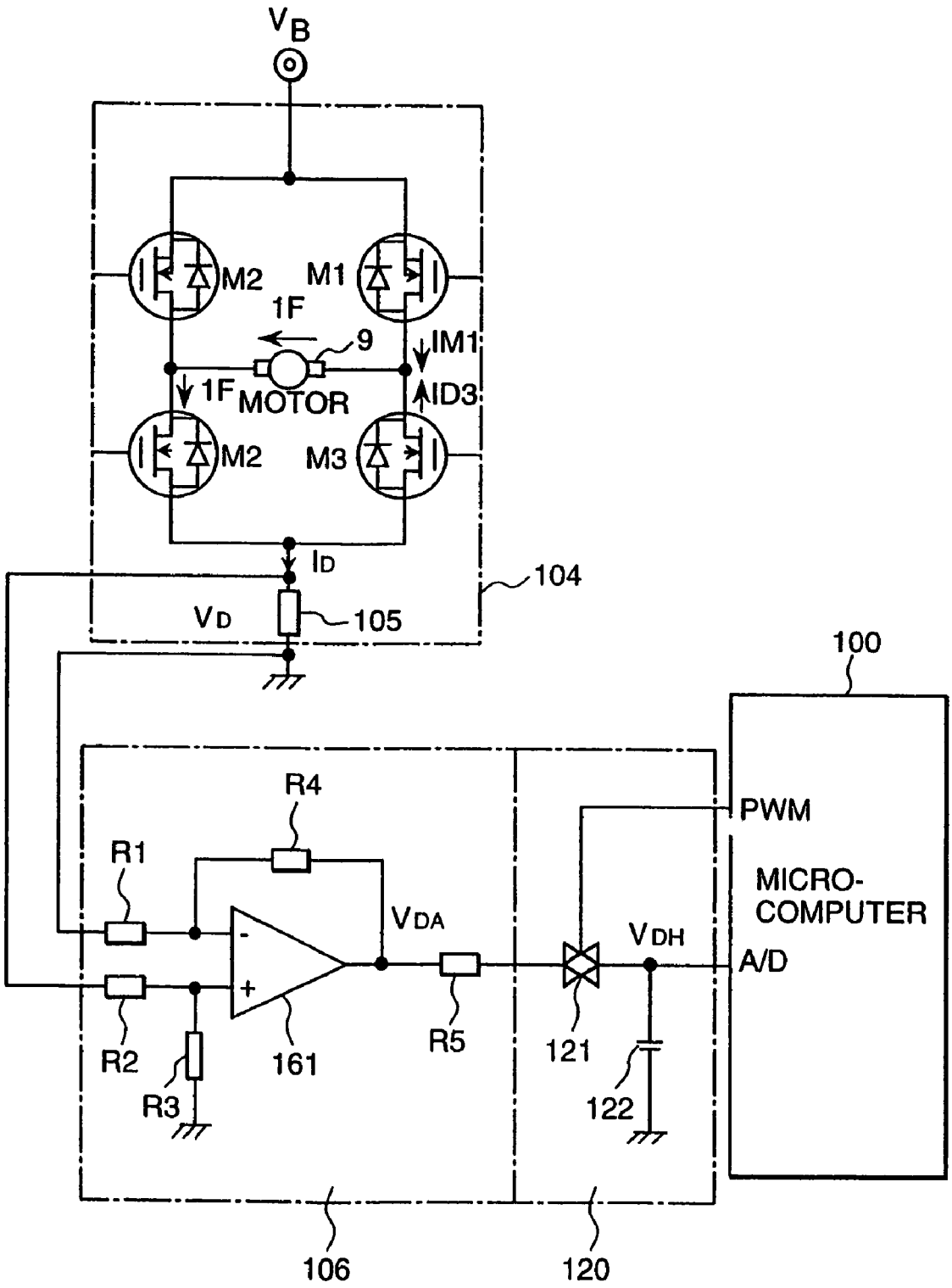
FIG. 14 is a view showing in detail another example of a method of detecting an electric current.

Next, the circuit of the detection portion of power device electric current I is explained in detail with reference to FIG. 14 and FIG. 15. In FIG. 14, the same numerals designate the same parts as FIG. 13.

Power device electric current ID which flows to shunt resistor 5 connected to H bridge type chopper circuit 4 is taken into amplifier 6 as shunt resistor voltage VD.

Amplifier 6 comprises operational amplifier 61, input resistors R1, R2, feedback resistors R3, R4, and output resistor R5.

Output voltage VDA of amplifier 6 is input to sample-hold circuit 12.

Sample-hold circuit 12 comprises analog switch 121 and capacitor 122, in which analog switch 121 turns on or off in synchronization with the PWM signal from microcomputer 1.

When turning on, the output signal of amplifier 6 is output as it is. When turning off, the voltage charged to capacitor 122 immediately before being turned off is held.

Because control signal PWM output by microcomputer 1 and control signals PWM1, PWM2 output by PWM drive circuit are the same pulse signals, It is possible to use control signals PWM1, PWM2 output by PWM drive circuit instead of control signal PWM output by microcomputer 1 as the signal which operates analog switch 121 in FIG. 13.

In that case, the signal which operates analog switch 121 can be obtained by taking logical add (OR) of control signal PWM1 and control signal PWM2.

Anyway, the power device electric current is sample-held by operating the analog switch based on the PWM signal which is finally the control signal of the power device of H bridge type chopper circuit.

Figure 15:
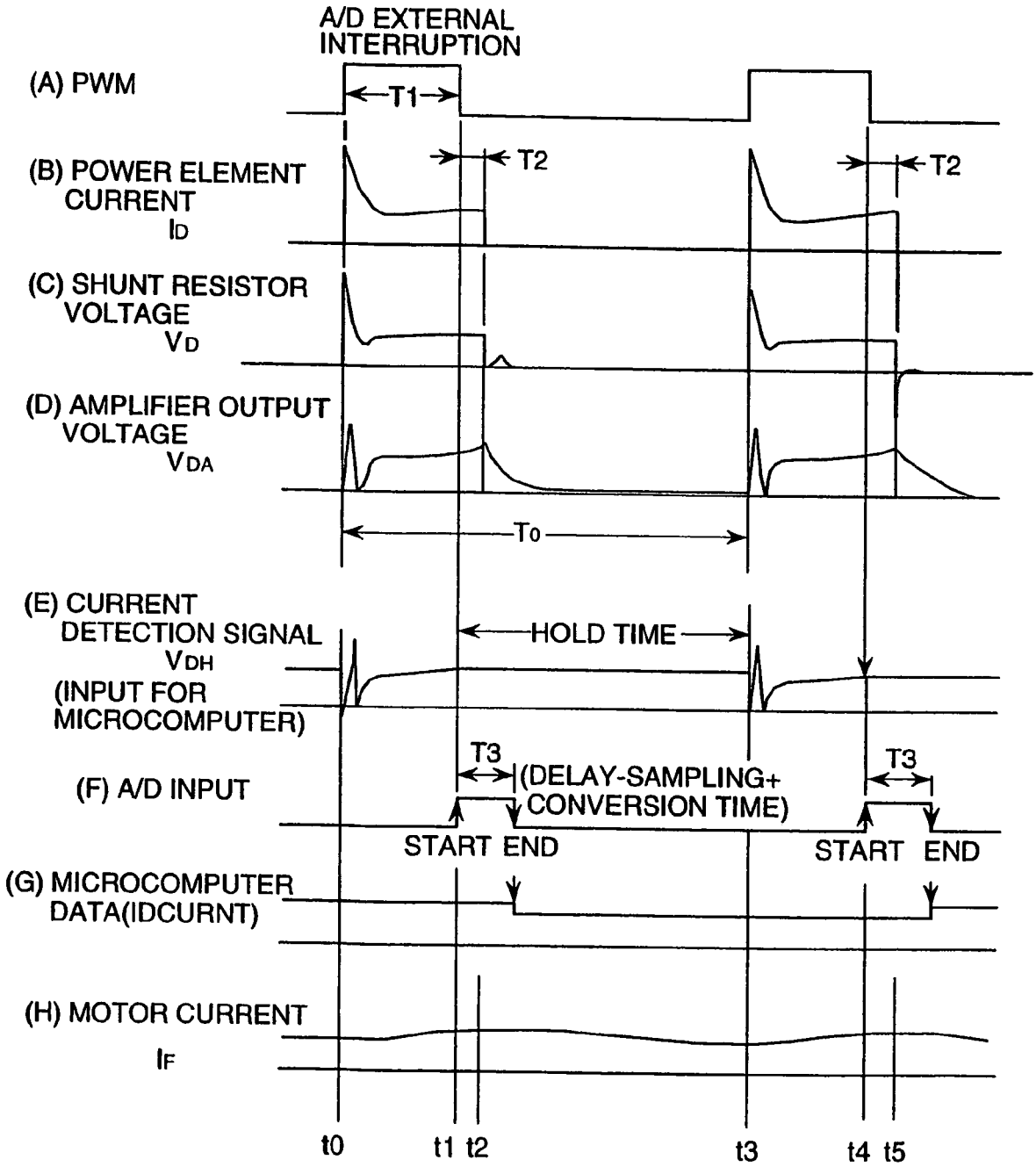
FIG. 15 is a timing chart to explain the electric current detection.

Here, the principle of the electric current detection is explained based on each electric current and voltage waveform by using FIG. 15.

FIG. 15(A) shows control signal PWM from microcomputer 1, and control signals PWM1 and PWM2 output from PWM drive circuit 8 are similar signals.

Control signal PWM is a repetition pulse in which it turns on at time t0 and turns off at time t1, then turns on at time t3 and turns off at time t4.

Although this pulse cycle T0 is constant, ON time T1 of this pulse is variable. The duty ratio (T1/T0) of this pulse changes by changing ON time T1 of the pulse according to the difference between actual opening signal TVF of throttle valve and throttle opening instruction TVC.

When a signal of 20 kHz is used as PWM signal, cycle T0 of the pulse is 50 μs.

FIG. 15(B) shows power device electric current ID, and when control signal PWM turns on, power device electric current ID starts to flow.

At this time, the overcurrent flows by the influence of reverse-recovery (recovery) characteristic etc. of power MOSFET.

Further, when control signal PWM is turned off, the electric current becomes 0 behind time T2 by the operation delay of power MOSFET. Delay time T2 is about several μs.

FIG. 15(C) shows shunt resistance voltage VD at both ends of shunt resistance 5. When power device electric current ID falls, some overshoots are generated by the influence of reactance L.

FIG. 15(D) shows output voltage VDA of amplifier 5, and the voltage VDA vibrates when rising at time t0 by the high frequency property of the operational amplifier, and when falling at time t2, the time delay is caused. Such an effect is caused because the PWM signal is a high frequency signal of 20 kHz as mentioned above.

Sample-hold circuit 12 is used when this signal is taken into microcomputer 1 to remove the influence of various changes, because the output voltage of amplifier 6 is a voltage signal with waveform shown in FIG. 15(D). The timing of the sample holding is synchronization with time t1, t4, that is, the falling edge of PWM signal. When turning off analog switch 121 in sample-hold circuit, amplifier output voltage VDA immediately before that is held in capacitor 122.

In fact, the PWM signal is a pulse signal as shown in FIG. 15(A). Therefore, analog switch 121 is turned off when this pulse signal changes from "ON" to "OFF", and amplifier output voltage VDA immediately before that is held in capacitor 122.

Although electric current detection signal VDH which is an output of sample-hold circuit 12 is equal to output voltage VDA of the amplifier of FIG. 15(D) from time t0 to time t1 as shown in FIG. 15(E), it is equal to the voltage held immediately before t1 after that time.

Further, the A/D taking of electric current detection signal VDH which is the output of sample-hold circuit 12 is begun as shown in FIG. 15 (F) synchronizing with the falling edge of the PWM signal by providing an external trigger to the A/D converter in microcomputer 1.

Thus, the difference of data due to the difference of timing is not generated by restricting the timing of the A/D conversion.

Although time t3 from the start of this A/D conversion to the end is different depending on analog signal value to be converted, it is from several μs to tens of μs in this example.

When the A/D conversion ends, the converted digital signal is taken into the main body of microcomputer 1 as microcomputer data (IDCURNT) as shown in FIG. 15(G).

FIG. 15 (H) shows motor electric current IF which flows in motor 9. The electric current which flows between time t0 and time t1 corresponds to electric current IM1 which flows in power MOSFET M1 in FIG. 13 in this motor electric current Ir. The electric current which flows between time t1 and time t2 corresponds to flywheel electric current IM3 which flows in power MOSFET M3 in FIG. 13.

Therefore, because the current value immediately before the chopper circuit is turned off can be input, the current value not influenced by the vibration at the rising of the current etc. can be detected.

When PWM control is performed, the A/D taking can be performed in the middle of the ON period of the PWM signal by providing the trigger signal.

Namely, the A/D taking is started at the timing of time ((t1−t0)/2) when the PWM signal is in an ON state from time t0 to t1. Because the timing approaches the rising of the pulse when the duty ratio becomes small and the ON period of the pulse shortens, it will be influenced by the vibration at the time of the rising as shown in FIG. 15(D). However, this influence is omitted by providing an external trigger at the falling edge of the PWM signal and doing the A/D taking like this embodiment.

The effect of this invention can be confirmed by connecting the same degree of resistance as increment of the impedance of the winding by the temperature rise of the motor in the feeder circuit of the motor, and checking that the opening of the throttle valve do not change.

In the present invention, the temperature of the motor can indirectly be obtained by the calculation as an impedance of the winding according to the voltage applied and the electric current which flows in the motor.

Further, it is preferable to detect the current value when the throttle valve is controlled to be at the full-close position, for example, at the engine brake (At the fuel cut when decelerating) or the full-close learning, etc.

It is possible to measure the temperature of the motor by mounting the temperature sensor directly in the housing. It is also possible to regard the temperature of the engine cooling water as that of the motor when the temperature of the motor is managed by the engine cooling water. Further, it is possible to substitute the temperature of atmosphere where the motor is put. Because the impedance of the winding of the motor is changed depending on the temperature, it is possible to detect this impedance.

The expression of "The opening of the throttle valve do not change", "The cycle of the engine does not change", "The output of the air amount sensor does not change", "Same opening", "same engine speed" and "Same air flow amount" in the present invention does not mean the change in the physical value is zero, or the difference of the physical value is not at all, but has the allowable width within the range which does not interfere to control, or the range which does not deviate from the object of the present invention.

Further, all of control parameters including the accelerator control amount are made constant, the throttle valve is made stationary at a specific opening. Next, the accelerator is depressed with the throttle valve being fixed so as not to move from its opening. At that time, the throttle valve controller increases the supply voltage to the motor because the target opening instruction value of the throttle valve increases. However, the difference between the target opening instruction value and the actual opening does not change because the throttle valve is fixed. The throttle valve controller further increases the supply voltage to the motor due to the action of the integration term. Supply voltage will increase like the lamp in such a state. The change in time of the supply voltage is determined by the difference between target opening instruction value and the actual opening, and the gain of the throttle valve controller. If the difference between the target opening instruction value and the actual opening is maintained in a fixed value, the change in time of the supply voltage will be determined only by the gain of the throttle valve controller.

The operation of the above-mentioned is executed at normal temperature, and the change of the time of the supply voltage is recorded. Next, the ambient temperature is raised to 125° C., the difference between the target opening instruction value and the actual opening is set as well as the operation of normal temperature, a similar operation is executed, and the change in time of the supply voltage is recorded. Whether the gain of the throttle controller is changed depending on the temperature is determined by comparing the change in time of the supply voltage at this time with the one at the normal temperature.

Further, all control parameters are made constant by mounting the heater on the motor and the heater is heated.

The temperature of the motor is about to rise along with the temperature rise of the heater, the impedance of the winding increases, and thus the electric current decreases. If the present invention is applied, the compensator works to make compensation for this electric current decrease at once. Therefore, the supply capability of motor is compensated, and the opening is kept constant.

As a result, the air flow meter outputs the detection value of the air flow amount which does not change. Further, engine speed maintains the same revolution number.

This operation can be used together with the technology that The actual opening of the throttle valve is detected, the values are compared with the target opening instruction value, and the feedback control is performed so that the difference may become small.

It is possible to confirm by disconnecting the terminal of the throttle opening sensor for detecting the actual opening of the throttle valve, and being not able to do the feedback control in case that the above-mentioned technology is executed.

The amount of supply capability of the motor for the temperature change of the motor can be compensated even if the actual opening of the throttle valve is not input when the technology according to the above-mentioned embodiment is executed.

Even if the signal from the throttle opening sensor consequentially is cut off, the compensation operation is maintained against the change in the impedance of the motor due to the change in the temperature of the motor and the power-supply voltage in this embodiment.

POSSIBILITY FOR INDUSTRIAL USE

The present invention can be applied to a throttle valve controller which drives the throttle valve of the automobile by using the motor. Further, the present invention can be used for the control of the automobile, and for the control of a general motor.

The invention claimed is:

1. A control device for a motor driven throttle valve in which opening and closing of the throttle valve are controlled by a motor driven according to a control instruction signal for the throttle valve provided from a control unit, and in which said control instruction signal is corrected by performing feedback of the output of a sensor for detecting an opening of said throttle valve through a feedback system, wherein a specific value of said control instruction signal is different, according to a temperature condition of said motor, when the specific value is provided as said control instruction signal even if the feedback system breaks down.

2. A control device for a motor driven throttle valve in which an opening of the throttle valve is controlled by a motor, comprising a compensator for compensating a supply capability so that the opening of the throttle valve can be maintained at the same magnitude even if a resistance value of an energizing circuit of said motor changes with control parameters for determining the supply capability to said motor being maintained to a constant value.

3. A control device for a motor driven throttle valve for controlling an air flow amount supplied to an engine, comprising a microcomputer, a motor for driving said throttle valve to open and close, and a drive circuit for inputting a signal from said microcomputer and controlling a state of energizing of said motor, wherein said microcomputer has a compensator for compensating a supply capability so that an opening of the throttle valve can be maintained at the same magnitude even if a resistance value of an energizing circuit of said motor changes with control parameters input to said microcomputer and the temperature of said motor being maintained to a constant value.

* * * * *